US005799718A

United States Patent [19]

Comarteau et al.

[11] Patent Number: 5,799,718

[45] Date of Patent: Sep. 1, 1998

[54] DEVICE AND FRAME FOR PREHEATING A METAL CASTING CHANNEL

[75] Inventors: Jean-Louis Comarteau, Chalon-sur-Saone; Daniel Boudot, Saint-Remy; Christophe Liebaut, Mercurey; Patrice Nykiel, Beaumont-sur-Crosne, all of France

[73] Assignee: SEVA, Chalon-sur-Saone, France

[21] Appl. No.: 693,326

[22] PCT Filed: Feb. 1, 1995

[86] PCT No.: PCT/FR95/00112

§ 371 Date: Aug. 7, 1996

§ 102(e) Date: Aug. 7, 1996

[87] PCT Pub. No.: WO95/22240

PCT Pub. Date: Aug. 17, 1995

[30] Foreign Application Priority Data

Feb. 14, 1994 [FR] France ..... 94 01795

[51] Int. Cl.[6] ..... B22D 17/06; B22D 27/02

[52] U.S. Cl. ..... 164/306; 164/513

[58] Field of Search ..... 164/306, 119, 164/513, 507, 493, 323

[56] References Cited

U.S. PATENT DOCUMENTS 4,475,721 10/1984 Pamart ..... 266/236

5,183,097 2/1993 Boudot ..... 164/306

FOREIGN PATENT DOCUMENTS

| | | |
|---|---|---|
| 103 220 | 3/1984 | European Pat. Off. . |
| 638843 | 8/1928 | France . |
| 1476160 | 4/1967 | France . |
| 2 342 619 | 9/1977 | France . |
| 2 670 697 | 6/1992 | France . |

*Primary Examiner*—Joseph J. Hail, III

*Assistant Examiner*—I.-H. Lin

*Attorney, Agent, or Firm*—Sughrue, Mion, Zinn, Macpeak & Seas, PLLC

[57] ABSTRACT

A device for preheating a metal casting channel (3). The device is positioned in a rapidly removable manner by a frame (1) consisting of a stationary portion (12) and a movable portion (26). The channel (3) comprises a refractory part (5) surrounded by an insulating coating (7), an inductor (8) and refractory concrete (10) within a shell (11). The preheating device includes the inductor (8) and an element (2) made of a refractory and electrically conductive material. Said device is useful for evenly and uniformly preheating a metal casting channel (3).

9 Claims, 2 Drawing Sheets

DEVICE AND FRAME FOR PREHEATING A METAL CASTING CHANNEL

CROSS-REFERENCE TO RELATED APPLICATIONS

This application is a 371 of PCT/FR95/00112 filed Feb. 1 1995.

BACKGROUND OF THE INVENTION

The present invention concerns the preheating of a metal casting spout of the type comprising over its length an open hollow refractory element having a closed transverse section and enclosed by an insulating covering, which is in turn enclosed by an inductor enclosed in refractory concrete held in a casing.

Commonly assigned French Patent Application No. 93 01 497 describes a spout of the type mentioned above. Metal-transfer heating spouts prove especially advantageous for the transmission of a metal heated to high casting temperature, in particular for low-pressure bottom casting.

When casting operations are of a discontinuous nature, the liquid metal cannot remain for a relatively long period in the spout. Advantage is gained, in this case, by keeping the metal constantly preheated during this period.

In conventional systems such as that described in commonly assigned U.S. Pat. No. 4,475,721 to Pamart, preheating is accomplished using a graphite susceptor sleeve comprising a straight and a bent part, which causes a number of operating difficulties arising from the complexity of manufacture of the spout: i.e., problems linked to forming, cutting, and centering. These problems increase the cost of manufacture of the spout.

To solve these problems, a liquid metal-transmission heating device has been used. This device, which has a closed transverse section, extends upward and ends, on its upper face, in a casting orifice in order to feed at least one mold, and it incorporates, over its entire length, at least one heating element consisting of a coil-shaped inductor through whose cooled turns runs an alternating electric current.

Heating and maintenance of the liquid metal held in the refractory spout are effected by the inductor, through which runs a medium- or high-frequency alternating current. This heating method allows direct transfer to the liquid metal of electrical energy in the form of thermal energy. Because it does not make use of an intermediate element such as graphite, energy transfer is direct and efficiency is higher. The frequency running through the inductor typically falls within the range of 1,000–15,000 Hertz.

This device no longer ensures the internal preheating thereof, either before a casting run or between two successive casting operations.

The aforementioned Patent Application No. 93 01 497 proposes a method of preheating utilizing secondary means, e.g., an element using gas. However, this preheating device cannot be used for long, small-diameter spouts, such as those measuring one meter in length and having a diameter of less than ten centimeters. Furthermore, gas heating is not generally very precise.

SUMMARY OF THE INVENTION

This invention is intended to solve these problems. To this end, the preheating element according to the invention comprises the inductor of the casting spout and an element comprising a refractory material and an electrical conductor, in order to radiate energy uniformly over the inner surface of the spout.

In accordance with other features:

- the element composed of a refractory material and of an electric conductor is made of an austenitic metal, thereby yielding good energy output from the beginning to the end of the preheating operation;
- the element made of a refractory material is composed of a nickel alloy containing chrome;
- the element made of a refractory material is made of graphite;
- the transverse section of the element made of refractory material is positioned lower than, and centered in relation to, the cavity of the refractory element; and,
- the element made of refractory material is a bent tube having a constant radius of curvature.

The invention also concerns a frame allowing the rapidly-detachable positioning, in a casting spout, of an element made of a refractory material belonging to a preheating device resembling that described above. This configuration is intended to minimize heat loss in the spout between the end of preheating and the filling of the spout with metal.

To achieve this goal, the frame comprises a stationary member and a movable member to which the element made of refractory material is attached. The stationary member comprises a system for guiding the mobile member, so as to hold the refractory element centered in the part during the entire course of travel thereof.

According to other features:

- The stationary member comprises wheel rollers, with which guide rails belonging to the movable part are associated;
- since the stationary member is detachable, it incorporates at least one frame-attachment and spout-centering mechanism; and,
- the centering device comprises a pin which works in conjunction with a receptacle provided in the casing.

DETAILED DESCRIPTION OF THE PREFERRED EMBODIMENT

Figure 1:
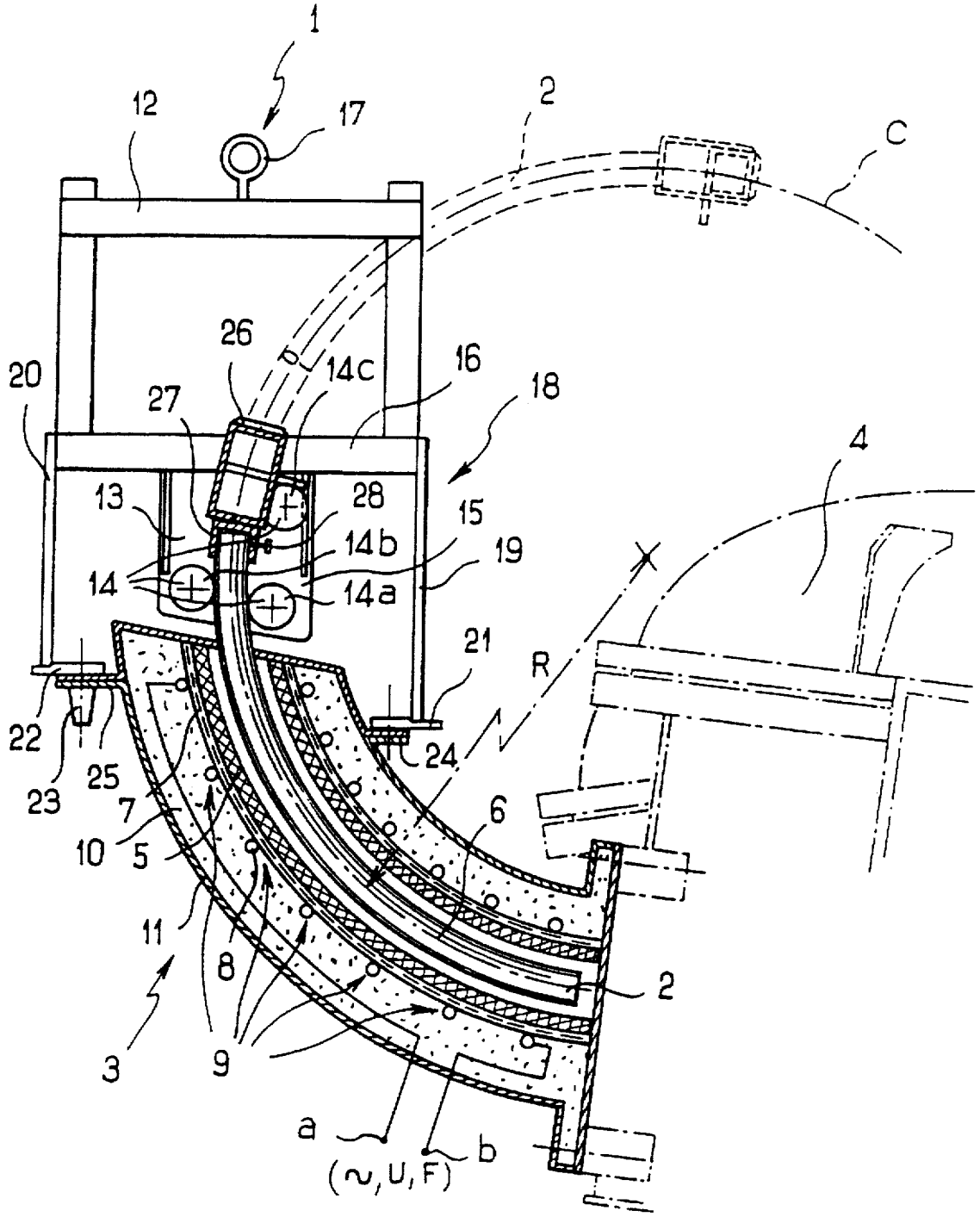
- FIG. 1 illustrates in schematic vertical cross-section a frame and a preheating device adapted for use with a casting spout.

The frame 1 and the preheating element 2 adapted for use with the casting spout as illustrated in FIG. 1 are suitable for the low-pressure casting of metals having high melting points (steels, superalloys, cast irons). The preheating device is shown in bold lines in the working (preheating) position and in broken lines in the released position.

The spout 3 is attached to a furnace 4 potentially containing a liquid metal.

The spout 3 consists of:

- a shaped part 5 made of an albuminous ceramic material incorporating an axis 6 having a constant radius of curvature R and a circular transverse section;
- an insulating covering 7 made of a fibrous fabric which encloses the shaped part 5
- a spiral inductor 8 composed of several turns 9 embedded in refractory concrete 10 contained in a metal casing 11.

The inductor is connected to an AC-generator, and a voltage U at a frequency F is supplied to the terminals a and b thereof.

The preheating element 2 consists of a metal tube made of a nickel alloy containing 15% chrome. It is bent to conform to the radius of curvature R of the axis of the shaped part 5.

The frame 1 comprises a mechanically-welded stationary parallelepiped-shaped member 12. The mechanically-welded members are assembled vertically and horizontally so as to form a cage. A guide system 13 is made integral, with the stationary member 12 of the frame. The guide system incorporates two set of wheel rollers 14 each arranged in threes (14*a*, 14*b*, 14*c*) in a single vertical plane. Two rollers 14*a*, 14*c* are positioned inside the circular path C of the preheating element 2. The third roller 14*b* is located outside the circular path C. These rollers are fastened to a plate 15, which is, in turn, attached to the lower horizontal mechanically-welded element 16 of the stationary member 12.

The stationary member 12 of the frame can be raised and moved using a lifting crank pin 17 attached at its upper part.

A casing-positioning device 18 is attached to the lower horizontal element 16. This device 18 comprises two vertical plates 19 and 20 extending downward and arranged on either side of the frame. Horizontal runners 21 and 22 are welded beneath the plates 19 and 20, respectively. The runner 22 is attached to tapered pins 23. The runners 21 and 22 are supported on horizontal extensions 24 and 25, respectively, of the metal frame 1, which are located on the upper part of the casting spout 3. Holes having a vertical axis and allowing the frame 1 to be centered using pins 23 are drilled through the plate 25. The frame 1 also comprises a mobile member 26 to which a sleeve 27 allowing insertion of the preheating element 2 is attached. The preheating element 2 is held in place in the sleeve 27 by means of a screw 28.

Figure 2:
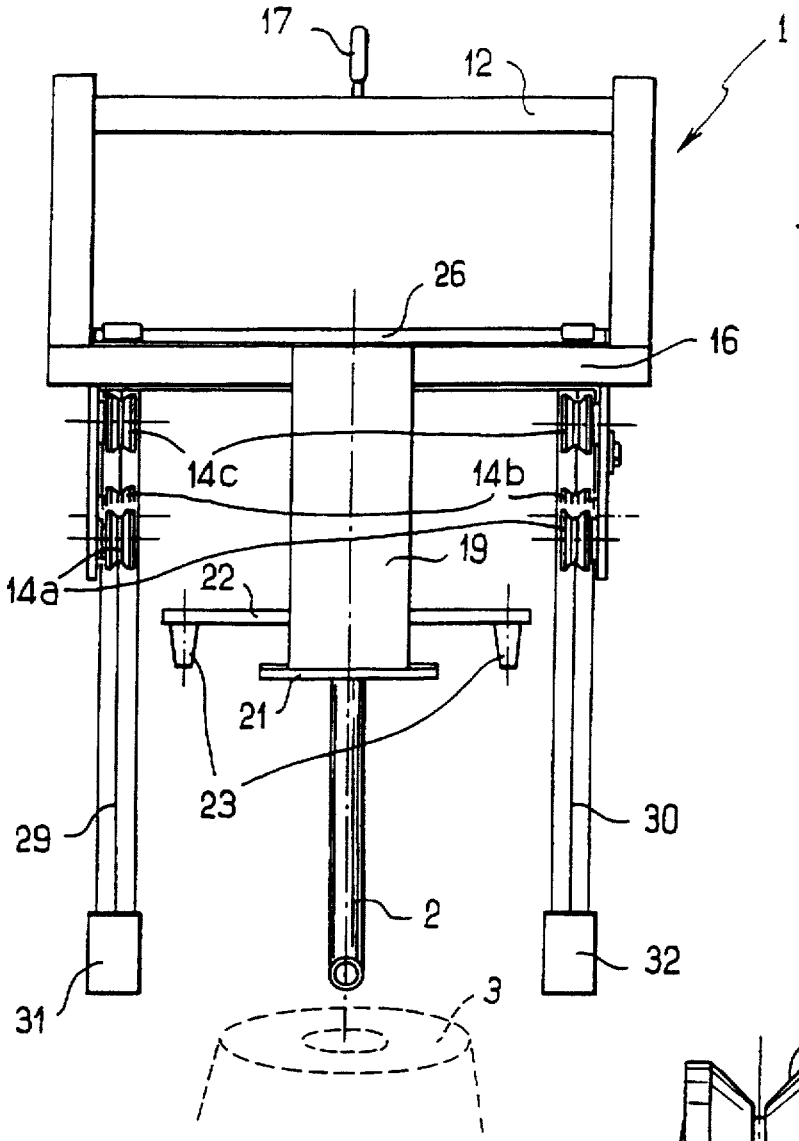
- FIG. 2 illustrates in schematic side view the frame and preheating device.

As shown in FIG. 2, the mobile member comprises two guide rails 29 and 30, each positioned in a vertical plane and incorporating a bend having the radius of curvature R. The guide rails 29 and 30 are arranged on either side of the preheating element 2, at a sufficient distance from the casting spout 3. Each lower end of the rails 29 and 30 comprises a stop-motion device 31 and 32. Each rail 29, 30 is guided by a series of three rollers 14*a*, 14*b*, 14*c*. The plane of each rail 29, 30, coincides with the plane of the series of three rollers 14*a*, 14*b*, 14*c*.

Figure 3:
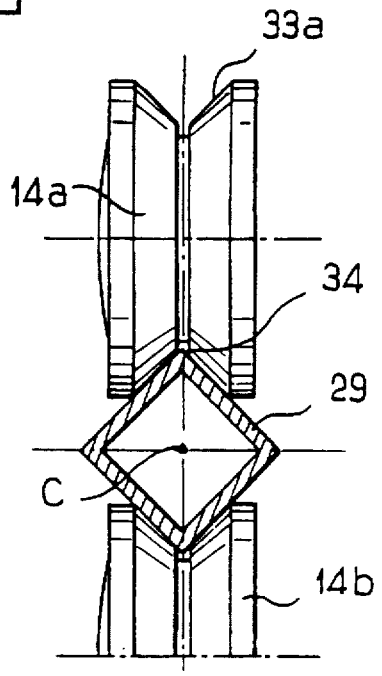
- FIG. 3 shows in detail a rail in FIG. 2 between the wheel rollers.

The rail 29 illustrated in transverse cross-section in FIG. 3 is guided between two wheel rollers 14*a* and 14*b*, which incorporate a V-shaped groove 33 allowing guidance by centering the edge 34 of the rail 29.

The rail is held in place by a second roller 14*b* positioned on the opposite side of the transverse cross-section of the rail 29.

The invention is in no way limited to the example described with reference to the attached figures. In a variant, the preheating element 2 may be formed by a small chain composed of interconnected balls, which may be installed and removed in spouts having complex shapes.

Depending on the value of the frequency F, the preheating element 2 may be hollow or solid. It is actually wiser to use a hollow preheating element 2 when the frequency is high (10,000 Hz), and a solid preheating element 2 when the frequency F is low (1,000 Hz).

This preheating element according to the invention allows a steady, uniform rise of the temperature at all points within the spout 3, thereby avoiding, on the one hand, cracking of the hollow refractory part during preheating, and, on the other, coagulation of the liquid metal during transfer through the spout 3.

We claim:

1. A device for preheating an elongate metal-casting spout (3) comprising, over a length thereof, a hollow refractory member (5) having a closed transverse section and enclosed, in succession in a radially outward direction, by an insulating covering (7), an electrical induction coil (8), and refractory concrete (10) contained within an outer casing (11), wherein said device for preheating comprises said induction coil, and an elongate element (2) insertable into and withdrawable from the hollow refractory member, said element being composed of a refractory, electrically conductive material subject to being heated by the induction coil to attendant radiate thermal energy uniformly over an inner surface of the spout a transverse section of said element being smaller than the transverse section of the hollow refractory member, and said element being axially centered within the hollow refractory member when inserted therein, and means for inserting said elongate element into the hollow refractory member and for withdrawing said elongate element therefrom.

2. A device according to claim 1, wherein the element (2) is made of an austenitic metal.

3. A device according to claim 1, wherein said element (2) is made of a nickel chrome alloy.

4. A device according to claim 1, wherein said element (2) is made of graphite.

5. A device according to claim 1, wherein the element (2) is a tube having a constant radius of curvature (R).

6. A frame for rapidly and detachably positioning an elongate element (2) of a preheating device according to claim 1 in a casting spout (3), wherein said frame comprises a stationary member (12) and a mobile member 26, 28 to which the element (2) is fastened, the stationary member (12) comprising a system (13) for guiding the mobile member element (2) centered in the hollow refractory member (5) during the insertion and withdrawal of said element.

7. A frame according to claim 6, wherein the stationary member (12) incorporates rollers (14, 14*a*, 14*b*, 14*c*) associated with guide rails (29, 30) mounted to the mobile member.

8. A frame according to claim 6, wherein, the stationary member comprises a mechanism (19–25) for attaching to the outer casing (11) and centering on the spout.

9. A frame according to claim 8, wherein said mechanism comprises a pin (23) cooperating with a receptacle (25) provided on the casing.

* * * * *